United States Patent [19]

Levinthal

[11] 4,086,110

[45] Apr. 25, 1978

[54] PROPELLANT MADE WITH COCRYSTALS OF CYCLOTETRAMETHYLENETETRANITRAMINE AND AMMONIUM PERCHLORATE

[75] Inventor: Michael L. Levinthal, Brigham City, Utah

[73] Assignee: Thiokol Corporation, Newtown, Pa.

[21] Appl. No.: 744,075

[22] Filed: Nov. 22, 1976

[51] Int. Cl.[2] ..... C06B 45/10

[52] U.S. Cl. ..... 149/19.4; 149/19.9; 149/20; 149/75; 149/76; 149/92

[58] Field of Search ..... 149/19.4, 19.9, 20, 149/75, 76, 92

[56] References Cited

U.S. PATENT DOCUMENTS

| | | | |
|---|---|---|---|
| 2,190,703 | 2/1940 | Davis | 149/75 |
| 3,259,531 | 7/1966 | Lofberg | 149/76 |
| 3,706,608 | 12/1972 | Geisler | 149/76 |
| 3,764,418 | 10/1973 | Sayles | 149/92 |
| 3,834,957 | 9/1974 | McDevitt et al. | 149/19.4 |
| 4,033,798 | 7/1977 | Brodman | 149/92 |

*Primary Examiner*—Edward A. Miller

*Attorney, Agent, or Firm*—Stanley A. Marcus; Edward E. McCullough

[57] ABSTRACT

Crystals of cyclotetramethylenetetranitramine (HMX) are dissolved in a suitable solvent, as are crystals of ammonium perchlorate. The two solutions are then mixed thoroughly and desiccated. This produces cocrystals of HMX and ammonium perchlorate that may be used as an oxidizer in rocket propellant, pyrotechnic materials, or in gas generators. Stoichiometric proportions are 50 parts of HMX to 30 parts of ammonium perchlorate.

2 Claims, No Drawings

PROPELLANT MADE WITH COCRYSTALS OF CYCLOTETRAMETHYLENETETRANITRAMINE AND AMMONIUM PERCHLORATE

The Government has rights in this invention pursuant to Subcontract No. GE10A0130M under Prime Contract N0003072C0108 awarded by the U.S. Navy.

BACKGROUND OF THE INVENTION

This invention relates broadly to high-energy oxidizers for solid, rocket propellants. More specifically, it relates to the preparation and use in propellants of cocrystals of cyclotetramethylenetetranitramine (HMX) and ammonium perchlorate.

The currently most widely used type of solid, rocket propellant comprises essentially a dispersion of finely divided inorganic oxidizer particles together with a powdered, metallic fuel, in an elastomeric binder. Such propellants are commonly made by mixing a major amount of the finely divided oxidizer with powdered metal and a minor amount of liquid, curable organic polymer, a curing agent for the organic polymer, and small amounts of certain special purpose additives. The resulting mixture is usually heated to an elevated temperature to cure the polymer to elastomeric form with the oxidizer dispersed therethrough.

The thrust that a given rocket structure develops depends importantly on the specific impulse of the propellant used therein, and the specific impulse in turn depends importantly on the nature of the oxidizer employed.

Although ammonium perchlorate has been probably the most successful and widely used oxidizer for solid rocket propellants, its high degree of solubility in water tends to affect aging properties of solid propellant adversely, primarily by the formation of perchloric acid from the ammonium perchlorate and ambient moisture. This necessitates the use of desiccants and hermetic seals with such rocket motors, especially in humid climates. Such undesirable products that may also be formed with residual moisture in the propellant can attack the aluminum powder, that is a common ingredient of propellant, to cause gassing and a resultant production of voids in the propellant. Such unplanned voids can greatly increase the burning surface of the propellant, and, hence, its burning rate, to an undesirable extent.

Cocrystals of ammonium perchlorate with burning-rate depressants have been described in the prior art literature as having been successfully used in solid propellant; but these also have been water soluble, and, hence, have done nothing to solve the problems associated with such water solubility in solid propellant.

SUMMARY OF THE INVENTION

The present invention, which overcomes these problems, is a new oxidizer, insoluble in water, comprising cocrystals of HMX and ammonium perchlorate. The invention also includes its preparation and use in solid propellant.

The cocrystals are prepared by dissolving HMX crystals in a solvent, and also dissolving ammonium perchlorate crystals in a solvent that is compatible and miscible with the first. The two solutions are then mixed together and the solvents removed by some desiccating process, such as by spraying in a vacuum, evaporation, etc. Size of the crystals is determined in the conventional manner, i.e., by control of time and temperature allowed for crystal growth.

The resulting crystals are included in solid, rocket propellant in the same manner as crystals of ammonium perchlorate or other common oxidizers. However, they have certain advantages that tend to improve both the shelf life and the mechanical properties of the resulting propellant. The cocrystals of the present invention are essentially insoluble in water, so that gassing and other problems associated with water solubility of the oxidizer are obviated. The cocrystal has been found to have surface characteristics that promote improved bonding to the propellant binder, compared to those of either HMX or ammonium perchlorate.

Objects of the invention are to provide a high-energy oxidizer for solid, rocket propellants that is inexpensive and easy to manufacture from readily-available materials; and that will provide rocket propallant having improved properties and shelf life.

Other objects and advantages of the invention will become apparent in the following detailed description.

DETAILED DESCRIPTION OF THE PREFERRED EMBODIMENTS

Cocrystals of the present invention are prepared by dissolving crystals of HMX in a solvent; dissolving crystals of ammonium perchlorate in a second quantity of solvent; mixing the two solutions; and removing the solvent by some evaporation process.

Although it is possible that the crystals HMX and of ammonium perchlorate could be dissolved in two different kinds of solvent that are miscible and nonreactive, it is preferred that the two solvents be of the same material. A preferred and effective solvent for this purpose is dimethyl sulfoxide. Other solvents that have been found to be useful are acetone, dimethyl formamide, nitromethane, and methylisobutyl ketone. Also, if desired, the crystals of HMX and ammonium perchlorate may be dissolved together in the same container of solvent.

Stoichiometric proportions of HMX and ammonium perchlorate in the resulting cocrystals have been found to be 62.5% and 37.5% by weight, respectively, or 50 parts of HMX to 30 parts of ammonium perchlorate.

Average size of the cocrystals is determined in the conventional manner, i.e., by regulating the time allowed for crystal growth. This involves also regulating the temperature and concentration of the solution, and the pressure and technique used for the drying process. The smallest crystals are obtained by flash drying or spraying a concentrated solution into a vacuum. Larger crystals are obtained by slower means of removing the solvent, such as by evaporation. A preferred means of removing the solvent is by evaporation in a vacuum.

EXAMPLE

At a temperature of about 75° F, 120 grams of HMX crystals and 120 grams of ammonium perchlorate crystals were added to a beaker containing 496 grams of dimethyl sulfoxide. The mixture was stirred until all solids were completely dissolved. The solution was then placed in a partial vacuum at a pressure of about 13 cm of mercury absolute and at a temperature of 80° F for 3 days. At the end of that period, the solvent had completely evaporated, leaving cocrystals of HMX and ammonium perchlorate. The crystals were hexagonal in cross section and elongated; and were found to be substantially insoluble in water.

The crystals were washed with water and dried; and were then subjected to a physical and chemical analysis, wherein the stoichiometric proportions were established and the heat of reaction was found to be 526.8 cal./gm.

In a similar experiment, HMX crystals were dissolved in acetone, and ammonium perchlorate crystals were dissolved in a different container of acetone. The two solutions were then mixed and vacuum desiccated, resulting in formation of cocrystals identical to those described above.

The cocrystals begin to form in the solution at saturation thereof, and grow as the solvent is removed by some technique involving evaporation. For the sake of securing crystals of a desired size and uniformity, it may be found that, in certain applications, the optimum yield per unit of time will indicate the desirability of recovering the cocrystals from the solution before all of the solvent has been removed. In such cases, cocrystals of the desired size may be removed by filtering the solution through a screen or series of screens. Undersized crystals may be recycled by returning them to the solution and redissolved either by adding more solvent, by raising the temperature thereof, or both. In this way the process of preparing the cocrystals may be made to be continuous. Also, the evaporated solvent may be continually recovered by well-known techniques and returned to the solution in the desired quantities.

As has been described in the prior literature regarding other cocrystals of ammonium perchlorate, the new oxidizer of the invention may be substituted for ammonium perchlorate in the otherwise conventional formulations for solid propellants. Such propellants are cited in a report titled "Cocrystallizing Additives with Ammonium Perchlorate and Their Effect on the Burning Rate of Polyurethane Propellants" by S. T. Balke. Elastomeric binders used in these propellants were polyurethane and polyisobutene. Other commonly used binders are hydroxylterminated polybutadiene and isophorone diisocyanate.

A typical propellant formulation useful for the invention is the following in parts by weight.

| | Parts |
|---|---|
| Cocrystals of HMX and ammonium perchlorate (ranging from 30–300 microns, weight mean diameter) | 40 to 80 |
| Carboxyl-terminated polybutadiene (mol. wt. from 500–6,000) | 15 to 35 |
| Curing composition (0.05 to 1 part iron octoate, and 0.5 to 5 prts imine epoxide-the latter made of 1–10 parts by weight of tris(1-(2-methyl) aziridine) phosphine oxide to each part by weight of trifunctional epoxide resin | 0.5 to 6 |
| Aluminum powder | 4 to 24 |

The dry ingredients are thoroughly mixed with the liquid prepolymer. It is then cast into a vertically-positioned, rocket motor case, in which a mandrel for forming a central, longitudinal perforation in the propellant is typically supported. The filled case is then placed in an oven and heated to about 135° F until the binder is cured to form an elastomeric polymer. The central mandrel is then withdrawn from the propellant charge.

An invention has been described that provides an advance in the art of solid propellant technology. Although it has been set forth in considerable detail, it should be noted that many details may be altered without departing from the scope of the invention, as it is defined in the following claims.

The invention claimed is:

1. A solid propellant for rockets, comprising the following, cured composition in parts by weight:

| | |
|---|---|
| Cocrystals of cyclotetramethylenetetranitramine and ammonium perchlorate | 40 – 80 parts |
| Aluminum powder | 4 – 24 parts |
| Organic elastomer selected from polyurethane, carboxyl-terminated polybutadiene, and isophorone diisocyanate (molecular weights of about 500 – 6,000) | 15 – 40 parts. |

2. The propellant of claim 1 wherein the cocrystals range in size from 30 – 300 microns weight mean diameter.

* * * * *